US005777509A

United States Patent [19]

Gasparik

[11] Patent Number: 5,777,509

[45] Date of Patent: Jul. 7, 1998

[54] APPARATUS AND METHOD FOR GENERATING A CURRENT WITH A POSITIVE TEMPERATURE COEFFICIENT

[75] Inventor: Frank Gasparik, Monument, Colo.

[73] Assignee: Symbios Logic Inc., Fort Collins, Colo.

[21] Appl. No.: 668,657

[22] Filed: Jun. 25, 1996

[51] Int. Cl.[6] ..... G05F 1/46

[52] U.S. Cl. ..... 327/542; 327/538; 327/539; 327/543; 323/312; 323/315

[58] Field of Search ..... 327/538, 539, 327/542, 543; 323/312, 315

[56] References Cited

U.S. PATENT DOCUMENTS

| | | | |
|---|---|---|---|
| 3,715,609 | 2/1973 | Hallen | 327/513 |
| 4,220,877 | 9/1980 | Giordano | 327/378 |
| 4,588,941 | 5/1986 | Kerth et al. | 323/314 |
| 4,593,208 | 6/1986 | Single | 327/539 |
| 5,038,053 | 8/1991 | Djenguerian et al. | 327/513 |
| 5,200,655 | 4/1993 | Feldt | 327/346 |
| 5,304,918 | 4/1994 | Khieu | 323/315 |
| 5,391,980 | 2/1995 | Thiel et al. | 323/314 |
| 5,483,196 | 1/1996 | Ramet | 330/257 |
| 5,654,665 | 8/1997 | Menon et al. | 327/541 |

*Primary Examiner*—David C. Nelms
*Assistant Examiner*—Andrew Q. Tran
*Attorney, Agent, or Firm*—Paul J. Maginot; Wayne P. Bailey

[57] ABSTRACT

A bias current generator includes a first circuit component having a first voltage developed across a pair of terminals thereof, the first voltage decreasing as an operating temperature of the first circuit component increases. The bias current generator further includes a second circuit component having a second voltage developed across a pair of terminals thereof, the second voltage decreasing as an operating temperature of the second circuit component increases. In addition, the bias current generator includes an impedance element connected to the first circuit component and the second component, the impedance element (1) having an impedance which increases as an operating temperature of the impedance element increases, and (2) having a first current flowing therethrough, wherein a decrease in the first voltage causes a corresponding increase in the first current, and a decrease in the second voltage causes a corresponding increase in the first current. Moreover, the bias current generator includes a mirroring circuit for generating a second current which mirrors the first current flowing through the impedance element. A method for generating a bias current that counteracts the effects temperature has upon electron and hole mobility is also disclosed.

20 Claims, 5 Drawing Sheets

APPARATUS AND METHOD FOR GENERATING A CURRENT WITH A POSITIVE TEMPERATURE COEFFICIENT

BACKGROUND OF THE INVENTION

The present invention relates generally to electrical current regulation, and more specifically to a bias generator for generating a bias current that counteracts the effect that temperature has upon electron and hole mobility.

In complementary metal oxide semiconductor (CMOS) integrated circuits both P-channel Metal Oxide Semiconductor Field Effect Transistor (PMOSFET) devices and N-channel Metal Oxide Semiconductor Field Effect Transistor (NMOSFET) devices are incorporated into a common substrate. Transconductance ($g_{fs}$), as measured in micromhos, is the extent to which drain current ($I_D$) changes in response to a change in gate-to-source voltage ($V_{gs}$); that is, $g_{fs}=dI_D/dV_{gs}$.

It is well known that PMOSFET and NMOSFET devices have a transconductance characteristic that has a negative temperature coefficient (i.e. a transconductance that increases with a decrease in temperature and decreases with an increase in temperature). A negative temperature coefficient transconductance characteristic causes a decrease in the switching speeds of PMOSFET and NMOSFET devices as temperature increases. The decrease in switching speeds of PMOSFET and NMOSFET devices is a direct result of a decrease in the electron and hole mobility associated with an increase in temperature. To offset the effects of a negative temperature coefficient transconductance characteristic, it is known to inject a proportional to absolute temperature bias current into the circuit.

In CMOS circuits, bipolar transistors are commonly regarded as parasitic vertical devices because bipolar transistors cause a vertical current to flow through the substrate whereas essentially the rest of the CMOS elements cause a horizontal current to flow across the surface of the substrate. However, when desired in a CMOS circuit bipolar PNP transistors may be implemented in an $N_{well}$ CMOS process, wherein a transistor base is formed from an $N_{well}$ diffusion, a transistor collector is formed from a P-type substrate, and a transistor emitter is formed from $P^+$ of a P-channel drain/source diffusion. Likewise, bipolar NPN transistors may be implemented in a $P_{well}$ CMOS process, wherein a transistor base is formed from an $P_{well}$ diffusion, a transistor collector is formed from am N-type substrate, and a transistor emitter is formed from $N^+$ of an N-channel drain/source diffusion. In both cases, the emitter-base voltage ($V_{EB}$) has a large negative temperature coefficient whose value is a function of fabrication.

One of the best known ways of obtaining a proportional to absolute bias current is to take the difference in the $V_{EB}$ values of two bipolar devices operating at different current densities. This difference in $V_{EB}$ values is developed across a resistor to obtain the proportional to absolute temperature bias current. However, the bias current in known bias current generators does not adequately compensate for the decrease of electron and hole mobility associated with an increase of temperature. That is, known bias current generators are not able to generate a high enough bias current to compensate for the decrease in electron and hole mobility caused by a negative temperature coefficient transconductance characteristic of CMOS devices, when temperature increases.

For the foregoing reasons, there is a need for a bias current generator which sufficiently increases bias current as temperature increases in order to effectively counteract the negative effect that temperature has upon electron and hole mobility of CMOS devices.

SUMMARY OF THE INVENTION

The present invention is directed to a bias generator that satisfies this need for a bias current that counteracts the effect that temperature has upon electron and hole mobility.

In accordance with one embodiment of the present invention, there is a bias current generator which includes a first circuit component having a first voltage developed across a pair of terminals thereof, said first voltage decreasing as an operating temperature of the first circuit component increases. The bias current generator further includes a second circuit component having a second voltage developed across a pair of terminals thereof, said second voltage decreasing as an operating temperature of the second circuit component increases. In addition, the bias current generator includes an impedance element connected to said first circuit component and said second component, said impedance element (1) having an impedance which increases as an operating temperature of said impedance element increases, and (2) having a first current flowing therethrough, wherein a decrease in said first voltage causes a corresponding increase in said first current, and a decrease in said second voltage causes a corresponding increase in said first current. Moreover, the bias current generator includes a mirroring circuit for generating a second current which mirrors the first current flowing through the impedance element.

Pursuant to another embodiment of the present invention, there is provided a bias current generator which includes a first circuit component having a first voltage developed across a pair of terminals thereof, said first voltage decreasing as an operating temperature of the first circuit component increases. The bias current generator further includes a second circuit component having a second voltage developed across a pair of terminals thereof, said second voltage decreasing as an operating temperature of the second circuit component increases. In addition, the bias current generator includes a third circuit component having a third voltage developed across a pair of terminals thereof, said third voltage decreasing as an operating temperature of the third circuit component increases. Moreover, the bias current generator includes an impedance element connected to said first circuit component, said second circuit component and said third circuit component, said impedance element (1) having an impedance which increases as an operating temperature of said impedance element increases, and (2) having a first current flowing therethrough, and wherein (1) a decrease in said first voltage causes a corresponding increase in said first current, (2) a decrease in said second voltage causes a corresponding increase in said first current, and (3) a decrease in said third voltage causes a corresponding increase in said first current.

In accordance with yet another embodiment of the present invention, there is provided a method for generating a bias current. The method includes the steps of (1) developing a voltage across an impedance element so as to generate a first current; and (2) mirroring the first current so as to generate a second current. In the above method, (1) said voltage increases at a first rate as an operating temperature of said impedance element increases, and (2) said impedance element has an impedance which increases at a second rate as an operating temperature of said impedance element increases, and (3) said first rate is greater than said second rate. Further in the above method, said developing step includes the steps of (1) developing a first component voltage across a pair of terminals of a first circuit component, said first voltage decreasing as an operating temperature of the first circuit component increases, and (2) developing a second component voltage across a pair of terminals of a second circuit component, said second voltage decreasing as an operating temperature of the second circuit component increases. Additionally, in the above method, (1) a decrease in said first component voltage causes a corresponding increase in said first current, and (2) a decrease in said second component voltage causes a corresponding increase in said first current.

It is therefore an object of the present invention to provide a new and useful bias current generator.

It is another object of the present invention to provide an improved bias current generator.

It is still another object of the present invention to provide a new and useful method of generating a bias current.

It is another object of the present invention to provide an improved method of generating a bias current.

It is yet another object of the present invention to provide a bias current generator that counteracts the effect that temperature has upon electron and hole mobility.

It is yet another object of the present invention to provide a new and useful bias generator which can be implemented in the standard CMOS process.

It is a further object of the present invention to provide a bias current generator that counteracts the effect that temperature has on the switching speeds of PMOSFET and NMOSFET devices.

It is yet another object of the present invention to provide a new and useful method for generating a bias current that counteracts the effect that temperature has upon electron and hole mobility.

It is yet a further object of the present invention to provide a new and useful method which can be implemented in the standard CMOS process.

These and other features, aspects, and advantages of the present invention will become better understood with regard to the following description, appended claims, and accompanying drawings.

DETAILED DESCRIPTION OF A PREFERRED EMBODIMENT

Figure 1:
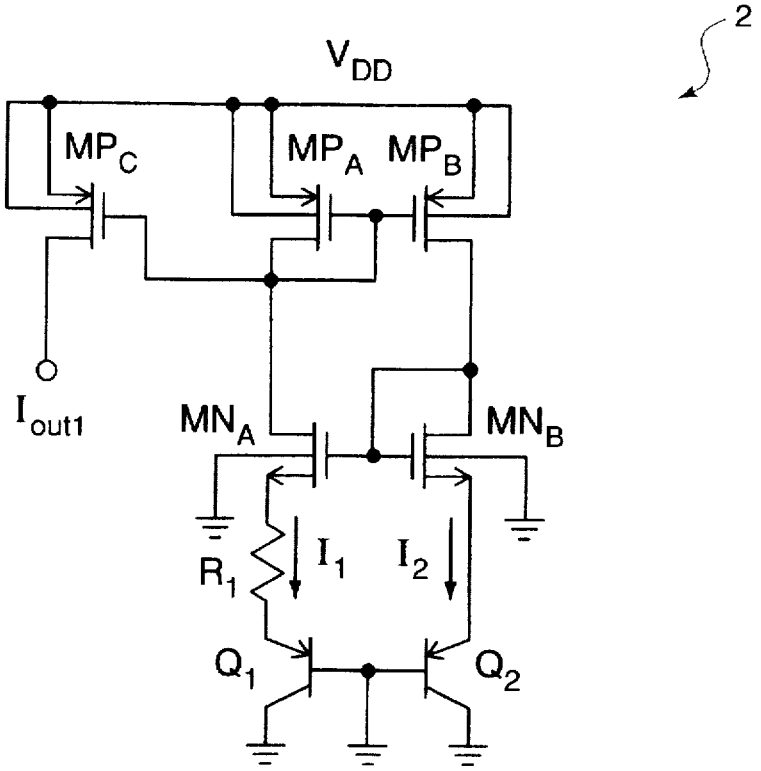
FIG. 1 PRIOR ART
FIG. 1 is a schematic diagram of a known bias current generator that generates a bias current with a positive temperature coefficient.

While the invention has been illustrated and described in detail in the drawings and foregoing description, such illustration and description is to be considered as exemplary and not restrictive in character, it being understood that only a preferred embodiments have been shown and described and that all changes and modifications that come within the spirit of the invention are desired to be protected.

Referring now to FIG. 1, there is shown a schematic diagram of a known bias current generator 2 that generates a bias current with a positive temperature coefficient. That is, bias current generator 2 generates a bias current $I_{OUT1}$ with a small positive temperature coefficient. The bias generator 2 uses two transistors $Q_1$ and $Q_2$ with a resistor $R_1$ to generate the bias current $I_{OUT1}$. The metal oxide semiconductor (MOS) devices $MP_A$ and $MP_B$ serve as a current mirror which forces the two currents $I_1$ and $I_2$ flowing through the transistor $Q_1$ and device $Q_2$ respectively to be substantially equal. The transistors $MN_A$ and $MN_B$ with their respective gate-source voltages form a voltage loop with the transistors $Q_1$ and $Q_2$ and the resistor $R_1$. This voltage loop may be represented by equation (1):

$$V_{GS}(MN_A)+I_1R_1+V_{EB}(Q_1)=V_{GS}(MN_B)+V_{EB}(Q_2) \quad (1)$$

where $V_{GS}(MN_A)$ represents the gate-source voltage of the transistor $MN_A$ expressed in Volts (V), $I_1$ represents the current flowing through the transistor $Q_1$ expressed in Amperes (A), $R_1$ represents the resistance of the resistor $R_1$ expressed in Ohms (Ω), $V_{EB}(Q_1)$ represents the emitter-base voltage of the transistor $Q_1$ expressed in Volts (V), $V_{GS}(MN_B)$ represents the gate-source voltage of the transistor $MN_A$ expressed in Volts (V), and $V_{EB}(Q_2)$ represents the emitter-base voltage of the transistor $Q_2$ expressed in Volts (V).

The emitter-base voltage $V_{EB}(Q_N)$ of a transistor $Q_N$ may be determined from equation (2):

$$V_{EB}(Q_N)=\frac{kT}{q}\ln\left(\frac{I_N}{I_{SN}A_{EN}}\right) \quad (2)$$

where $V_{EB}(Q_N)$ represents the emitter-base voltage of the transistor $Q_N$ expressed in Volts (V), k represents Boltzmann's constant of approximately $1.38\times10^{-23}$ Joules per Kelvin (J/K), T represents the absolute temperature expressed in Kelvin (K), q represents the charge of an electron which is approximately $1.60\times10^{-19}$ Coulombs (C), $I_N$ represents the current expressed in Amperes (A) flowing through the emitter of the transistor $Q_N$, $I_{SN}$ represents the reverse saturation current of the emitter-base diode of the transistor $Q_N$ expressed in Amperes per square centimeter ($A/cm^2$), and $A_{EN}$ represents the emitter area of the transistor $Q_N$ expressed in square centimeters ($cm^2$).

Substituting the right hand expression of equation (2) into equation (1) yields equation (3):

$$V_{GS}(MN_A)+I_1R_1+\frac{kT}{q}\ln\left(\frac{I_1}{I_{S1}A_{E1}}\right)=V_{GS}(MN_B)+\frac{kT}{q}\ln\left(\frac{I_2}{I_{S2}A_{E2}}\right) \quad (3)$$

where $I_{S1}$ represents the reverse saturation current of the emitter-base diode of the transistor $Q_1$ expressed in Amperes per square centimeter ($A/cm^2$), $A_{E1}$ represents the emitter area of the transistor $Q_1$ expressed in square centimeters ($cm^2$), $I_2$ represents the current expressed in Amperes (A) flowing through the transistor $Q_2$, $I_{S2}$ represents the reverse saturation current of the emitter-base diode of the transistor $Q_2$ expressed in Amperes per square centimeter ($A/cm^2$), and $A_{E2}$ represents the emitter area of the transistor $Q_2$ expressed in square centimeters ($cm^2$).

The currents $I_1$ and $I_2$ are substantially equal because the transistors $MP_A$ and $MP_B$ are matched devices and their source-gate voltages $V_{SG}(MP_A)$ and $V_{SG}(MP_B)$ are the same. Therefore, the transistors $M_{PA}$ and $M_{PB}$ form a current mirror and force the current $I_1$ to be substantially equal to the current $I_2$. Furthermore, because the transistors $Q_1$ and $Q_2$ are matched devices except for the emitter areas $A_{E1}$ and $A_{E2}$ respectively, the reverse saturation currents $I_s$, and $I_{S2}$ of the transistors $Q_1$ and $Q_2$ are substantially equal. Furthermore, because the transistors $MN_A$ and $MN_B$ are matched devices and the currents $I_1$ and $I_2$ are substantially equal, the gate-source voltages $V_{GS}(MN_A)$ and $V_{GS}(MN_B)$ are substantially equal (see equation (9) below, substituting $V_{GS}(MN_A)$ for $V_{SG}(MP_N)$). Therefore, after noting that the current $I_1$ substantially equals the current $I_2$, that the reverse saturation current $I_{S1}$ substantially equals the reverse saturation current $I_{S2}$, and that the gate-source voltage $V_{GS}(MN_A)$ substantially equals the gate-source voltage $V_{GS}(MN_B)$, equation (9) may be simplified to equation (4):

$$I_1R_1+\frac{kT}{q}\ln\left(\frac{I_1}{I_{S1}A_{E1}}\right)=\frac{kT}{q}\ln\left(\frac{I_1}{I_{S1}A_{E2}}\right) \quad (4)$$

Because the transistor $MP_C$ and the transistors $MP_A$ are matched devices and share the same source-gate voltage, the drain current $I_{OUT1}$ of the transistor $MP_c$ mirrors the current $I_1$ flowing through the transistor $Q_1$ and substantially through the transistor $MP_A$. As a result, the collection of like terms of equation (4) and the realization that the bias current $I_{OUT1}$ is substantially equal to $I_1$ yields equation (5):

$$I_{OUT1}=\left(\frac{kT}{qR_1}\right)\ln\left(\frac{A_{E1}}{A_{E2}}\right) \quad (5)$$

where $I_{OUT1}$ represents the bias current in Amperes (A) flowing through the transistor $MP_c$. Therefore, at a given temperature T, the emitter area $A_{E1}$ of the transistor $Q_1$, the emitter area $A_{E2}$ of the transistor $Q_2$, and the resistance of the resistor $R_1$ are the circuit design elements which control the bias current $I_{OUT1}$.

As stated above, the bias current $I_{OUT1}$ has a slight positive temperature coefficient. As can be seen from equation (5), if the terms other than the temperature T were substantially constant as temperature increases, the bias current $I_{OUT1}$ would have a positive temperature coefficient. However, the resistance of the resistor $R_1$ is not substantially constant as temperature increases. Diffused resistors like the resistor $R_1$ increase over temperature and therefore have a positive temperature coefficient. The positive temperature coefficient of diffused resistors are dependent upon the material used to fabricate the resistor. For example heavier doped diffusions such as $P^+$ and $N^+$ yield resistors with lower temperature coefficients than resistors made with the typical $N_{WELL}$ or $P_{WELL}$ diffusion process. The rate of change in the resistance of diffused resistors like the resistor $R_1$, however, is slower than the rate of the increase in the temperature T. Therefore, as can be seen from equation (5), the bias current $I_{OUT1}$ increases with an increase in the temperature T because the value of $T/R_1$ increases despite the positive temperature coefficient of the resistor $R_1$.

The temperature T, however, has an exponential effect upon electron and hole mobility in the standard CMOS process. This effect upon electron and hole mobility may be represented by equation (6):

$$\frac{\mu(T)}{\mu(T_0)}=\left(\frac{T}{T_0}\right)^{-3/2} \quad (6)$$

where T represents the temperature in Kelvin (K), $\mu(T)$ represents the mobility of electrons or holes at the temperature T, $T_o$ represents room temperature in Kelvin (K) which is about 300 K, $\mu(T_o)$ represents the mobility of electrons or holes at the room temperature $T_o$. Because the bias current $I_{OUT1}$ of FIG. 1 increases at a rate of approximately the change in the temperature ($\Delta T$) over the change in the resistance ($\Delta R_1$) of the resistor $R_1$ ($\Delta T/\Delta R_1$), the bias current $I_{OUT1}$ does not adequately increase in order to compensate for the exponential decrease of electron and hole mobility as shown in equation (3).

Figure 2:
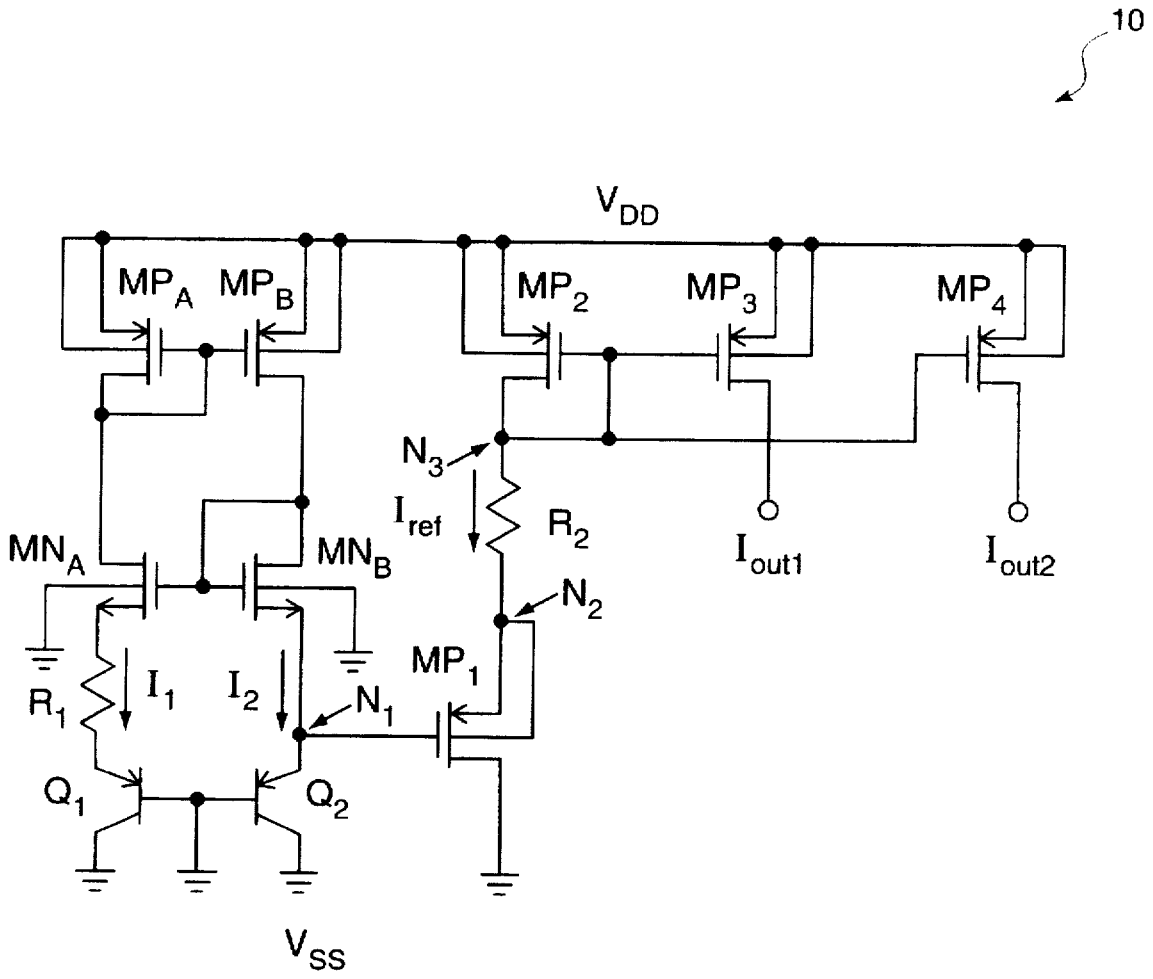
FIG. 2 is a schematic diagram of a first embodiment of a bias current generator which incorporates the features of the present invention therein.

Now referring to FIG. 2, there is shown a schematic diagram of a first embodiment of a bias generator 10 which incorporates the features of the present invention therein. The bias current generator 10 may be fabricated using an $N_{well}$ CMOS process. In the preferred embodiment the transistors $MP_A$, $MP_B$, $MP_1$, $MP_2$, $MP_3$, and $MP_4$ are P-channel metal oxide semiconductor field effect transistors (PMOSFET). Likewise, the transistors $MN_A$ and $MN_B$ are N-channel metal oxide semiconductor field effect transistors (NMOSFET). The transistors $Q_1$ and $Q_2$ are parasitic PNP bipolar junction transistors (PNP BJT), and the resistors $R_1$ and $R_2$ are diffused resistors.

The transistor $MP_A$ is matched with the transistor $MP_B$ (i.e. the transistors are manufactured such that they have quite similar operating characteristics). Likewise, the transistor $MP_2$ is matched with the transistors $MP_3$ and $MP_4$, the transistor $MN_A$ is matched with the transistor $MN_B$, and the transistor $Q_1$ is matched with the transistor $Q_2$, except that the emitter area $A_{E2}$ of the transistor $Q_2$ is smaller than the emitter area $A_{E1}$ of the transistor $Q_1$. It should be appreciated by those skilled in the art that the above devices are matched only to simplify the design process and that non-matched devices could be used. It should further be appreciated by those skilled in the art that if transistors $Q_1$ and $Q_2$ are not matched devices, or if the current $I_1$ is not substantially equal to the current $I_2$ then the emitter area $A_{E2}$ need not be smaller than the emitter area $A_{E1}$. Furthermore, it should be appreciated by those skilled in the art that the use of non-matched devices will result in a bias generator 10 that generates a bias current $I_{OUT1}$ that does not track temperature as well as the bias generator 10 would with matched devices.

The source and the substrate of the transistor $MP_A$ and the source and the substrate of the transistor $MP_B$ are connected to the reference voltage $V_{DD}$. The gate of the transistor $MP_A$ is connected to the gate of the transistor $MP_B$ thereby forming a first current mirror. Likewise, the source and the substrate of the transistor $MP_2$, the source and the substrate of the transistor $MP_3$, and the source and the substrate of the transistor $MP_4$ are connected to the reference voltage $V_{DD}$. The gate of the transistor $MP_2$ is connected at the node $N_3$ to the gate of the transistor $MP_3$, and to the gate of the transistor $MP_4$ thereby forming a second current mirror.

The drain of the transistor $MP_A$ is connected to the gate of the transistor $MP_A$ and to the drain of the transistor $MN_A$. The drain of the transistor $MP_B$ is connected to the drain of the transistor $MN_B$, and the drain of the transistor $MN_B$ is connected to the gate of the transistor $MN_B$. The gate of the transistor $MN_B$ is connected to the gate of the transistor $MN_A$. The substrate of the transistor $MN_B$ and the substrate of the transistor $MN_A$ are connected to the reference voltage $V_{SS}$. The resistor $R_1$ is connected between the source of the transistor $MN_A$ and the emitter of the transistor $Q_1$. The emitter of the transistor $Q_2$ is connected to the source of the transistor $MN_B$ at the node $N_1$. The base of the transistor $Q_2$ is connected to the base of the transistor $Q_1$. The base and the collector of the transistor $Q_1$, and the base and the collector of the transistor $Q_2$ are connected to the reference voltage $V_{SS}$ which is ground.

The gate of the transistor $MP_1$ is connected at the node $N_1$ to the source of the transistor $MN_B$ and to the emitter of the transistor $Q_2$. The drain of the transistor $MP_1$ is connected to the reference voltage $V_{SS}$, and the substrate of the transistor $MP_1$ is connected at the node $N_2$ to the source of the transistor $MP_1$. Finally, the resistor $R_2$ is connected between the node $N_2$ and the node $N_3$.

The reference current $I_{REF}$ flows through the resistor $R_2$. The bias current $I_{OUT1}$ flowing out of the drain of the transistor $MP_3$ mirrors the reference current $I_{REF}$ that flows out of the drain of the transistor $MP_2$ and through the resistor $R_2$. Likewise, the bias current $I_{OUT2}$ flowing out of the drain of the transistor $MP_4$ mirrors the reference current $I_{REF}$ that flows out of the drain of the transistor $MP_2$ and through the resistor $R_2$.

The operation of the first embodiment depicted in FIG. 2 will now be discussed in detail. As can be seen by comparing the bias current generator 2 shown in FIG. 1 to the bias current generator 10 shown in FIG. 2, the transistors $MP_A$, $MP_B$, $MN_A$, $MN_B$, $Q_1$, and $Q_2$ as well as the resistor $R_1$ function in the same manner. As a result the currents $I_1$ and $I_2$ of FIG. 2 may be represented by equation (5) as set forth above.

As a result of the standard CMOS process, the resistor $R_1$ has a positive temperature coefficient typically in the range from a few hundred to a few thousand parts per million per Kelvin (PPM/K). The positive temperature coefficient for the resistor $R_1$ changes at a rate that is slower than the change in temperature. Therefore, as shown in equation (5), the current $I_1$ has a positive temperature coefficient despite the positive temperature coefficient of the resistor $R_1$. Referring now to equation (2), an increase in the current $I_1$ would result in a small increase in the emitter-base voltage $V_{EB}(Q_1)$ of the transistor $Q_1$ if everything remained constant. However, because the reverse saturation current $I_{S1}$ increases exponentially with an increase in the temperature T, a smaller emitter-base voltage $V_{EB}(Q_1)$ of the transistor $Q_1$ can drive the same current $I_1$ that a larger emitter-base voltage $V_{EB}(Q_1)$ drove at a lower temperature T. The net effect is that even though the currents $I_1$ and $I_2$ are increasing as temperature increases, the emitter-base voltages $V_{EB}(Q_1)$ and $V_{EB}(Q_2)$ are decreasing as temperature increases. Therefore, $V_{EB}(Q_1)$ and $V_{EB}(Q_2)$ have a negative temperature coefficient typically of about −2 millivolts per Kelvin (mV/K) which does not substantially change with process variation or operating conditions.

The path between the reference voltages $V_{DD}$ and $V_{SS}$ that goes through the source-gate voltage $V_{SG}(MP_2)$ of the transistor $MP_2$, the voltage $V_{R2}$ across the resistor $R_2$, the source-gate voltage $V_{SG}(MP_1)$ of the transistor $MP_1$, and the emitter-base voltage $V_{EB}(Q_2)$ of the transistor $Q_2$, can be expressed by equation (7):

$$V_{DD} - V_{SG}(MP_2) + \overbrace{I_{REF}R_2}^{V_{R2}} + V_{SG}(MP_1) + V_{EB}(Q_2) + V_{ss} \tag{7}$$

where $V_{R2}$ represents the voltage across the resistor $R_2$ as a result of the reference current $I_{REF}$ flowing through the resistor $R_2$. Equation (7) solved for the reference current $I_{REF}$ yields equation (8):

$$I_{REF} = \frac{V_{DD} - V_{SG}(MP_2) - V_{SG}(MP_1) - V_{EB}(Q_2) - V_{SS}}{R_2} \tag{8}$$

The reference voltages $V_{DD}$ and $V_{SS}$ are usually predetermined by design criteria. For example, $V_{SS}$ is typically ground and $V_{DD}$ is typically between 3.3 volts and 5.0 volts but is likely to fall below 3 volts in the future for deep submicron CMOS devices (i.e. devices with a channel length of less than 0.3 microns). Furthermore, for a given current $I_2$ the emitter-base voltage $V_{EB}(Q_2)$ can be determined from equation (2) and at room temperature is typically about 700 millivolts (mV).

The source-gate voltages $V_{SG}(MP_1)$ and $V_{SG}(MP_2)$ are dependent upon their respective drain currents $I_{D1}$ and $I_{D2}$ which are both substantially equal to the reference current $I_{REF}$ and are also dependent upon other parameters which are usually set by the manufacturing process. Assuming the design criteria requires a predetermined bias current $I_{OUT1}$ for a given temperature T, the reference current $I_{REF}$ is substantially equal to the bias current $I_{OUT1}$ due to the current mirror formed by the transistors $MP_2$ and $MP_3$. Furthermore, the drain current $I_{D1}$ of the transistor $MP_1$ and the drain current $I_{D2}$ of transistors $MP_2$ are substantially equal to the reference current $I_{REF}$ because the gate currents of MOS transistors are usually negligible compared to the drain currents, the source-emitter voltages $V_{SG}(MP_1)$ and $V_{SG}(MP_2)$ may be determined from equation (9):

$$V_{GS}(MP_N) = V_T + \sqrt{\frac{2t_{ox}}{\mu_p \epsilon_o \epsilon_r} I_D(L/W)} \tag{9}$$

where $\mu_p$ represents the mobility of holes expressed in square centimeters per Volt second ($cm^2$/ V sec), $\epsilon_o$ represents the permitivity of free space expressed in Farads per centimeter (F/cm), $\epsilon_r$ represents the relative dielectric constant of the semiconductor and is dimensionless, $t_{ox}$ represents the thickness of the gate oxide expressed in centimeters (cm), $V_T$ represents the threshold voltage of the transistor $MP_N$ expressed in Volts (V), $I_D$ represents the drain current of the transistor $MP_N$ expressed in Amperes (A), W represents the width of the channel of the transistor $MP_N$ expressed in centimeters (cm), and L represents the length of the channel of the transistor $MP_N$ expressed in centimeters (cm).

An inherent quality of the standard CMOS process is that the threshold voltage $V_T$ of a MOS transistor has a negative temperature coefficient typically of about −2.6 mV. As shown in equation (9), the source-gate voltage $V_{SG}$ is directly dependent upon the threshold voltage $V_T$. Therefore, the source-gate voltages $V_{SG}(MP_1)$ and $V_{SG}(MP_2)$ have a negative temperature coefficient because as temperature increases, the threshold voltage $V_T$ decreases and causes a decrease in the source-gate voltages $V_{SG}(MP_1)$ and $V_{SG}(MP_2)$.

Figure 3:
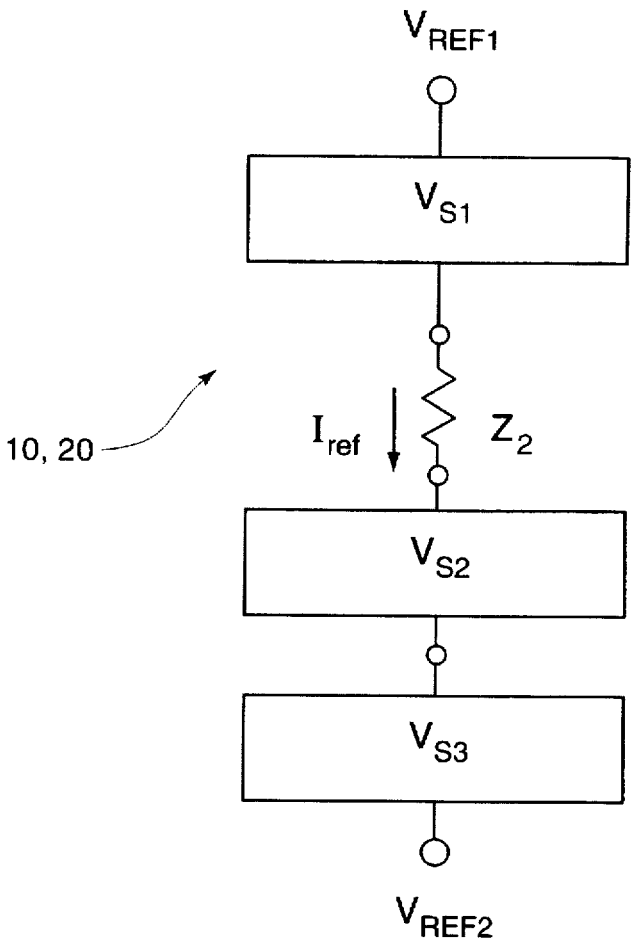
FIG. 3 is a simplified block diagram of the bias current generator shown in FIG. 2.

Referring now to FIG. 3, there is shown a simplified block diagram of the bias current generator 10 shown in FIG. 2. The elements of FIG. 2 correspond to the blocks of FIG. 3 in the following manner: the source-gate voltage $V_{SG}(MP_2)$ of the transistor $MP_2$ corresponds with the output voltage of the voltage source $V_{S1}$; the gate-source voltage $V_{SG}(MP_1)$ of the transistor $MP_1$ corresponds with the output voltage of the voltage source $V_{S2}$; the emitter-base voltage $V_{EB}(Q_2)$ of the transistor $Q_2$ corresponds with the output voltage of the voltage source $V_{S3}$; the resistor $R_2$ corresponds with the impedance element $Z_2$; the reference voltage $V_{DD}$ corresponds with the reference voltage $V_{REF1}$; and the reference voltage $V_{SS}$ corresponds with the reference voltage $V_{REF2}$. Therefore as can be seen from FIG. 3, the voltage sources $V_{S1}$, $V_{S2}$, and $V_{S3}$ along with the reference voltages $V_{REF1}$ and $V_{REF2}$ generate a voltage $V_{Z2}$ across the impedance element $Z_2$ which may be represented by equation (10):

$$V_{Z2} = V_{REF1} - V_{S1} - V_{S2} - V_{S3} - V_{REF2} \tag{10}$$

The reference voltages $V_{REF1}$ and $V_{REF2}$ remain substantially constant with a change in temperature. However, the output voltages of the voltage sources $V_{S1}$, $V_{S2}$, and $V_{S3}$ decrease with an increase in temperature. Therefore, as can be seen from equation (10), the voltage $V_{R2}$ across the impedance element $Z_2$ increases with an increase in temperature and causes a reference current $I_{REF}$ to flow through the impedance element $Z_2$. The reference current $I_{REF}$ that flows through the impedance element $Z_2$ can be determined from the equation (11):

$$I_{REF} = \frac{V_{Z2}}{Z_2} \tag{11}$$

where $V_{Z2}$ represents the voltage expressed in Volts (V) across the impedance element $Z_2$, and $Z_2$ represents the impedance expressed in Ohms (Ω) of the impedance element $Z_2$. As discussed above, the impedance of impedance element $Z_2$ increases with an increase in temperature but at a rate slower than the increase in the voltage $V_{Z2}$ across the impedance element $Z_2$. Therefore, as can be seen from equation (11), the reference current $I_{REF}$ has a positive temperature coefficient because the reference current $I_{REF}$ increases with an increase in temperature.

Figure 4:
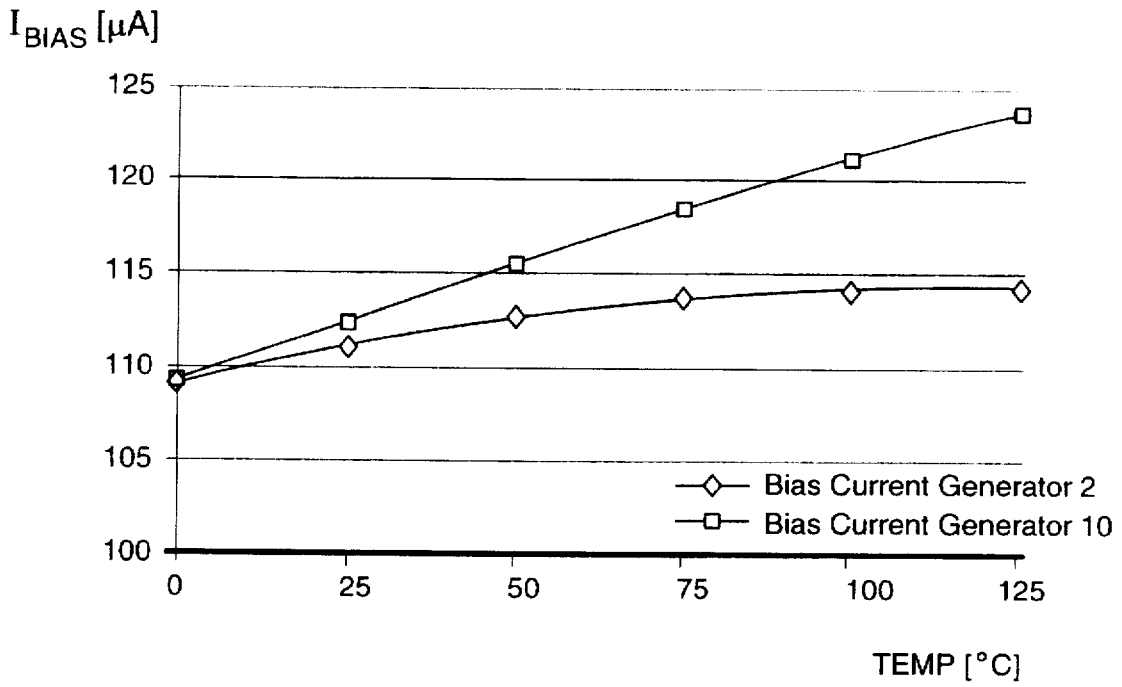
FIG. 4 is a graph comparing the effect of temperature upon the bias currents generated by the bias current generators shown in FIGS. 1 and 2.

Referring now to FIG. 4, there is shown a graph comparing the effect of temperature upon the bias current $I_{BIAS}$ generated by the known bias current generator 2 (FIG. 1), and by the bias current generator 10 (FIG. 2) of the present invention. As can be seen from FIG. 4, the bias current generator 10 of the present invention has a more dramatic increase in bias current $I_{BIAS}$ as temperature increases than the known bias current generator 2. This more dramatic increase in the bias current $I_{BIAS}$ is a direct result of using three voltage sources having a negative temperature coefficient to drive the resistor $R_2$. Furthermore, this more dramatic increase in the bias current $I_{BIAS}$ is the reason that the bias current generator 10 counteracts more effectively the effect that increased temperature has upon electron and hole mobility, than the known bias generator 2.

Figure 5:
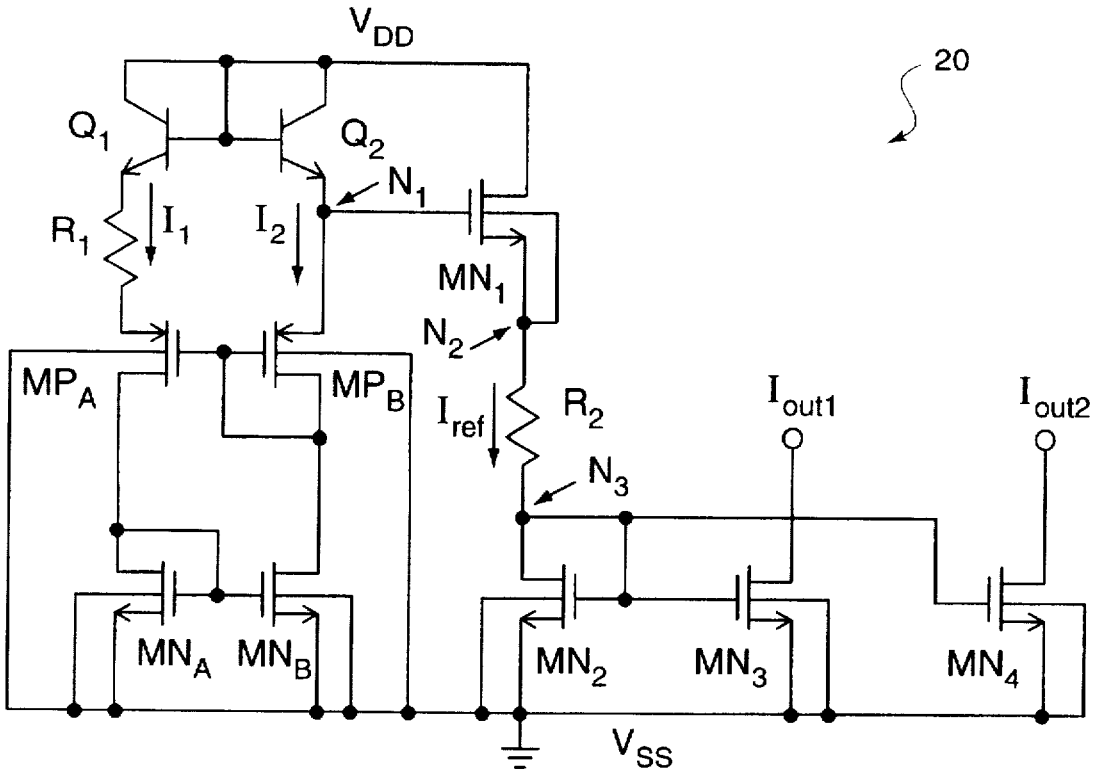
FIG. 5 is a schematic diagram of a second embodiment of a bias current generator which incorporates the features of the present invention therein.

Now referring to FIG. 5, there is shown a schematic diagram of a second embodiment of a bias current generator 20 which incorporates the features of the present invention therein. As previously mentioned, the bias current generator 10 (FIG. 2) may be fabricated using an $N_{well}$ CMOS process. The bias current generator 20 (FIG. 5) is a $P_{well}$ CMOS representation of the bias current generator 10 (FIG. 2). In particular, the bias current generator 20 includes transistors $MN_A$, $MN_B$, $MN_1$, $MN_2$, $MN_3$, and $MN_4$ which are N-channel metal oxide semiconductor field effect transistors (NMOSFET). The bias current generator also includes transistors $MP_A$ and $MP_B$ which are P-channel metal oxide semiconductor field effect transistors (PMOSFET), transistors $Q_1$ and $Q_2$ which are parasitic NPN bipolar junction transistors (NPN BJT), and the resistor $R_1$ and $R_2$ which are diffused resistors.

The transistor $MN_A$ is matched with the transistor $MN_B$ (i.e. the transistors are manufactured such that they have quite similar operating characteristics). Likewise, the transistor $MN_2$ is matched with the transistor $MN_3$ and the transistor $MN_4$, the transistor $MP_A$ is matched with the transistor $MP_B$, and the transistor $Q_1$ is matched with the transistor $Q_2$ except that the emitter area $A_{E2}$ of the transistor $Q_2$ is smaller than the emitter area $A_{E1}$ of the transistor $Q_1$. It should be appreciated by those skilled in the art that the above devices are matched only to simplify the design process and that non-matched devices could be used. It should further be appreciated by those skilled in the art that if the transistors $Q_1$ and $Q_2$ are not matched devices or if the current $I_1$ is not substantially equal to the current $I_2$ then the emitter area $A_{E2}$ need not be smaller than the emitter area $A_{E1}$. Furthermore, it should be appreciated by those skilled in the art that the use of non-matched devices will result in a bias generator 20 that generates a bias current $I_{OUT1}$ that does not track temperature as effectively as the bias generator 20 would with matched devices.

The source and the substrate of the transistor $MN_A$ and the source and the substrate of the transistor $MN_B$ are connected to the reference voltage $V_{SS}$ which is ground. The gate of the transistor $MN_A$ is connected to the gate of the transistor $MN_B$ thereby forming a first current mirror. Likewise, the source and the substrate of the transistor $MN_2$, the source and the substrate of the transistor $MN_3$, and the source and the substrate of the transistor $MN_4$ are connected to the reference voltage $V_{SS}$. The gate of the transistor $MN_2$ is connected at the node $N_3$ to the gate of the transistor $MN_3$, and to the gate of the transistor $MN_4$ thereby forming a second current mirror.

The drain of the transistor $MN_A$ is connected to the gate of the transistor $MN_A$ and to the drain of the transistor $MP_A$. The drain of the transistor $MN_B$ is connected to the drain of the transistor $MP_B$, and the drain of the transistor $MP_B$ is connected to the gate of the transistor $MP_B$. The gate of the transistor $MP_B$ is connected to the gate of the transistor $MP_A$. The substrate of the transistor $MP_B$ and the substrate of the transistor $MP_A$ are connected to the reference voltage $V_{SS}$. The resistor $R_1$ is connected between the source of the transistor $MP_A$ and the emitter of the transistor $Q_1$. The emitter of the transistor $Q_2$ is connected to the source of the transistor $MP_B$ at the node N1. The base of the transistor $Q_2$ is connected to the base of the transistor $Q_1$. The base and the collector of the transistor $Q_1$, and the base and the collector of the transistor $Q_2$ are connected to the reference voltage $V_{DD}$.

The gate of the transistor $MN_1$ is connected at the node $N_1$ to the source of the transistor $MP_B$ and to the emitter of the transistor $Q_2$. The drain of the transistor $MN_1$ is connected to the reference voltage $V_{DD}$, and the substrate of the transistor $MN_1$ is connected at the node $N_2$ to the source of the transistor $MN_1$. Finally, the resistor $R_2$ is connected between the node $N_2$ and the node $N_3$.

The reference current $I_{REF}$ flows through the resistor $R_2$. The bias current $I_{OUT1}$ flowing into the drain of the transistor $MN_3$ mirrors the reference current $I_{REF}$ that flows into the drain of the transistor $MN_2$ and through the resistor $R_2$. Likewise, the bias current $I_{OUT2}$ flowing into the drain of the transistor $MN_4$ mirrors the reference current $I_{REF}$ that flows into the drain of the transistor $MN_2$ and through the resistor $R_2$.

Since the bias current generator 20 (FIG. 5) is simply a $P_{well}$ CMOS representation of the bias current generator 10 (FIG. 2), a detailed discussion regarding the operation of the bias current generator 20 is not warranted. Referring again to FIG. 3, the elements of the bias current generator 20 correspond to the blocks shown in FIG. 3 in the following manner: the gate-source voltage $V_{GS}(MN_2)$ of the transistor $MN_2$ corresponds with the output voltage of the voltage source $V_{S1}$; the gate-source voltage $V_{GS}(MN_1)$ of the transistor $MN_1$ corresponds with the output voltage of the voltage source $V_{S2}$; the base-emitter voltage $V_{BE}(Q_2)$ corresponds with the output voltage of the voltage source $V_{S3}$; the resistor $R_2$ corresponds with the impedance element $Z_2$; the reference voltage $V_{DD}$ corresponds with the reference voltage $V_{REF2}$; and the reference voltage $V_{SS}$ corresponds with the reference voltage $V_{REF1}$. Therefore, as can be seen from FIG. 3, the voltage sources $V_{S1}$, $V_{S2}$, and $V_{S3}$ along with the reference voltages $V_{REF1}$ and $V_{REF2}$ generate a voltage $V_{R2}$ across the impedance element $Z_2$ which may be represented by equation (10) hereinabove.

The reference voltages $V_{REF1}$ and $V_{REF2}$ remain substantially constant with a change in temperature. However, the output voltages of the voltage sources $V_{S1}$, $V_{S2}$, and $V_{S3}$ decrease with an increase in temperature. Therefore, as can be seen from equation (10), the voltage $V_{Z2}$ across the impedance element $Z_2$ increases with an increase in temperature and causes a reference current $I_{REF}$ to flow through the impedance element $Z_2$. The reference current $I_{REF}$ that flows through the impedance element $Z_2$ can be determined from the equation (11) hereinabove.

Furthermore, the impedance of impedance element $Z_2$ increases with an increase in temperature but at a rate slower than the increase in the voltage $V_{Z2}$ across the impedance element $Z_2$. Therefore, as can be seen from equation (11), the reference current $I_{REF}$ has a positive temperature coefficient because the reference current $I_{REF}$ increases with an increase in temperature.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A bias current generator, comprising:

a first circuit component having a first voltage developed across a pair of terminals thereof, said first voltage decreasing as an operating temperature of said first circuit component increases;

a second circuit component having a second voltage developed across a pair of terminals thereof, said second voltage decreasing as an operating temperature of said second circuit component increases;

an impedance element connected to said first circuit component and said second circuit component, said impedance element (1) having an impedance which increases as an operating temperature of said impedance element increases, and (2) having a first current flowing therethrough, wherein a decrease in said first voltage causes a corresponding increase in said first current, and a decrease in said second voltage causes a corresponding increase in said first current; and a mirroring circuit generating a second current which mirrors the first current flowing through said impedance element.

2. The bias current generator of claim 1, wherein said first circuit component, said second circuit component and said impedance element is interposed between a first reference potential and a second reference potential.

3. The bias current generator of claim 1, wherein said impedance element is interposed between said first circuit component and said second circuit component.

4. The bias current generator of claim 3, wherein:

said second circuit component includes a bipolar transistor having an emitter and a base, and said emitter and said base having the second voltage developed thereacross.

5. The bias current generator of claim 4, wherein:

said first circuit component includes a first field effect transistor having a first source and a first gate, and said first source and said first gate having the first voltage developed thereacross.

6. The bias current generator of claim 5, further comprising a third circuit component having a third voltage developed across a pair of terminals thereof, said third voltage decreasing as an operating temperature of said third circuit component increases, wherein:

said third circuit component includes a second field effect transistor having a second source and a second gate, and said second source and said second gate having the third voltage developed thereacross.

7. The bias current generator of claim 6, wherein:

said bipolar transistor is a PNP transistor, said first field effect transistor is a P-channel metal oxide semiconductor field effect transistor, and said second field effect transistor is a P-channel metal oxide semiconductor field effect transistor.

8. The bias current generator of claim 6, wherein:

said bipolar transistor is a NPN transistor, said first field effect transistor is a N-channel metal oxide semiconductor field effect transistor, and said second field effect transistor is a N-channel metal oxide semiconductor field effect transistor.

9. The bias current generator of claim 6, wherein:

said mirroring circuit includes a third field effect transistor having a third gate and a third source, said third field effect transistor generates the second current, said first gate is coupled to said third gate, and said first source is coupled to said third source.

10. The bias current generator of claim 9, wherein:

said mirroring circuit further includes a fourth field effect transistor having a fourth gate and a fourth source, said fourth field effect transistor generates a third current, said first gate is coupled to said fourth gate, and said first source is coupled to said fourth source.

11. The bias current generator of claim 4, wherein the second voltage decreases at a rate of about 2.0 millivolts per Kelvin.

12. The bias current generator of claim 6, wherein said first voltage and said third voltage each decrease at a rate of about 2.6 millivolts per Kelvin.

13. The bias current generator of claim 12, wherein said impedance element has a temperature coefficient between about 200 parts per million per Kelvin (PPM/K) and about 10000 parts per million per Kelvin (PPM/K).

14. The bias current generator of claim 1, wherein said impedance element is a diffused resistor.

15. A bias current generator, comprising:

a first circuit component having a first voltage developed across a pair of terminals thereof, said first voltage decreasing as an operating temperature of said first circuit component increases;

a second circuit component having a second voltage developed across a pair of terminals thereof, said second voltage decreasing as an operating temperature of said second circuit component increases;

a third circuit component having a third voltage developed across a pair of terminals thereof, said third voltage decreasing as an operating temperature of said third circuit component increases; and an impedance element connected to said first circuit component, said second circuit component and said third circuit component, said impedance element (1) having an impedance which increases as an operating temperature of said impedance element increases, and (2) having a first current flowing therethrough, wherein (1) a decrease in said first voltage causes a corresponding increase in said first current, (2) a decrease in said second voltage causes a corresponding increase in said first current, and (3) a decrease in said third voltage causes a corresponding increase in said first current.

16. The bias current generator of claim 15, further comprising a mirroring circuit for generating a second current which mirrors the first current flowing through said impedance element.

17. The bias current generator of claim 16, wherein:

said first circuit component includes a first field effect transistor having a first source and a first gate, said first source and said first gate having the first voltage developed thereacross, said second circuit component includes a bipolar transistor having an emitter and a base, said emitter and said base having the second voltage developed thereacross, said third circuit component includes a second field effect transistor having a second source and a second gate, and said second source and said second gate having the third voltage developed thereacross.

18. A method for generating a bias current, comprising the steps of:

developing a voltage across an impedance element so as to generate a first current; and mirroring the first current so as to generate a second current, wherein (1) said voltage increases at a first rate as an operating temperature of said impedance element increases, and (2) said impedance element has an impedance which increases at a second rate as an operating temperature of said impedance element increases, and (3) said first rate is greater than said second rate, wherein said developing step includes the steps of (1) developing a first component voltage across a pair of terminals of a first circuit component, said first voltage decreasing as an operating temperature of the first circuit component increases, and (2) developing a second component voltage across a pair of terminals of a second circuit component, said second voltage decreasing as an operating temperature of said second circuit component increases, and wherein (1) a decrease in said first component voltage causes a corresponding increase in said first current, and (2) a decrease in said second component voltage causes a corresponding increase in said first current.

19. The method of claim 18, wherein:

said developing step of a voltage across an impedance element further includes the step of developing a third component voltage across a pair of terminals of a third circuit component, said third voltage decreasing as an operating temperature of the third circuit component increases, and wherein a decrease in said third component voltage causes a corresponding increase in said first current.

20. The method of claim 19, wherein:

said first circuit component includes a first field effect transistor having a first source and a first gate, said first source and said first gate having the first voltage developed thereacross, said second circuit component includes a bipolar transistor having an emitter and a base, said emitter and said base having the second voltage developed thereacross, said third circuit component includes a second field effect transistor having a second source and a second gate, and said second source and said second gate having the third voltage developed thereacross.

* * * * *